United States Patent [19]

Vincent

[11] 4,430,821

[45] Feb. 14, 1984

[54] AMMUNITION CLIP

[76] Inventor: William A. Vincent, 6779 E. Cave Creek, Cove Creek, Ariz. 85331

[21] Appl. No.: 279,866

[22] Filed: Jul. 2, 1981

[51] Int. Cl.[3] ..... F41C 25/02

[52] U.S. Cl. ..... 42/50

[58] Field of Search ..... 42/50, 6, 7, 87, 18, 42/22; 24/116 A

[56] References Cited

U.S. PATENT DOCUMENTS

| | | | |
|---|---|---|---|
| 1,500,580 | 7/1924 | Fererro | 42/50 |
| 2,309,734 | 2/1943 | Klotsch | 24/116 A |
| 3,736,686 | 6/1973 | Moller et al. | 42/50 |

FOREIGN PATENT DOCUMENTS

| | | | |
|---|---|---|---|
| 647847 | 7/1937 | Fed. Rep. of Germany | 42/50 |
| 776859 | 11/1934 | France | 42/50 |
| 383799 | 1/1965 | Switzerland | 24/116 A |
| 1083694 | 9/1967 | United Kingdom | 24/116 A |

*Primary Examiner*—Charles T. Jordan

[57] ABSTRACT

An improved ammunition clip for a gun comprising a manually retracted and locked pressure plate to serve as a device to facilitate the rapid loading of cartridges into the ammunition clip, and according to another embodiment of this invention, incorporating in addition, a hinged section to serve as a device to allow for the rapid loading of cartridges without (necessitating the) removal of the ammunition clip from the gun.

2 Claims, 9 Drawing Figures

AMMUNITION CLIP

BACKGROUND OF THE INVENTION

1. Field of the Invention

This invention relates generally to firearms and, more particularly, to a quick-load ammunition clip for use in automatic and semi-automatic weapons.

2. Description of the Prior Art

Known ammunition clips generally comprise a chamber (often of rectangular cross-section) in which a pressure plate is spring biased. Loading the clip with ammunition requires the insertion of cartridges one at a time against the force of the pressure plate forcing the pressure plate further down into the chamber and compressing the spring. To avoid this cumbersome process, soldiers will often carry several loaded clips. When one clip is emptied, it is merely removed from the weapon, discarded, and replaced by a loaded clip. This, however, only postpones the time consuming task of manually loading the clip, and on the field of battle, the additional time could have extreme consequenses.

SUMMARY OF THE INVENTION

It is an object of the present invention to provide an improved ammunition clip.

It is a further object of the present invention to provide a quick-loading ammunition clip.

It is a still further object of the present invention to provide a quick-load ammunition clip which may be loaded with cartridges without removing the clip from the weapon.

According to a broad aspect of the invention there is provided an improved ammunition clip of the type wherein an elongated chamber formed by side walls and an end wall houses a pressure plate which is forced by a spring against cartridges stacked within said chamber so as to move cartridges remaining in said clip toward a first end thereof opposite said end wall each time a cartridge is extracted from said first end, the improvement comprising: first means coupled to said pressure plate and passing through said end wall for manually retracting said pressure plate against the force of said spring; and second means in said end wall for locking said first means and restraining said pressure plate in a retracted position to permit easy loading of cartridges into said clip through said first end.

According to a further aspect of the invention there is provided a rapid load ammunition clip, comprising: an elongated housing formed by side walls and an end wall; a pressure plate within said housing; a spring coupled between said end wall and said pressure plate for biasing said pressure plate toward an open end of said housing thereby moving ammunition remaining in said housing toward said open end; first means coupled to said pressure plate and passing through said end wall for manually retracting said pressure plate against the force of said spring; and second means within said end wall for locking said first means and restraining said pressure plate in a retracted position to permit easy loading of ammunition into said clip through said open end.

The above and other objects, features and advantages of the present invention will be better understood from the following detailed description taken in conjunction with the accompanying drawings, in which:

BRIEF DESCRIPTION OF THE DRAWINGS

FIG. 1 illustrates a weapon 10 having a prior art ammunition clip 12 associated therewith, which is shown in more detail in FIG. 2. The prior art clip is shown in cutaway form to illustrate an internal chamber which houses a pressure plate 14 and spring 16. It should be clear that the spring 16 urges the pressure plate 14 upward against bullets 18. Pressure plate 14 is incrementally forced downward as each bullet is inserted into the upper portion of the clip.

FIG. 3 illustrates the inventive rapid-load ammunition clip. An extension member 20 is fixed to the underside of pressure plate 14. A pivot member 22 is hingedly coupled to extension 20 and is also coupled to one end of a chain comprised of spheres 24 and narrow straight connectors 26. The other end of the chain is coupled to a pull ring 28. The chain passes concentrically through spring 16 and through aperture 30 in the bottom of the clip shown in FIG. 5.

Figure 5:
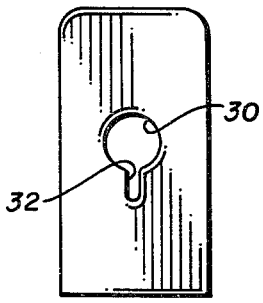
FIGS. 4 and 5 are top and bottom views of the clip shown in FIG. 3.

As can be seen in FIG. 5, aperture 30 is provided with a notch 32. Aperture 30 has a diameter which is larger than that of spheres 24. Notch 32 has a width which is less than the diameter of spheres 24, but greater than that of connecting portions 26.

Figure 4:
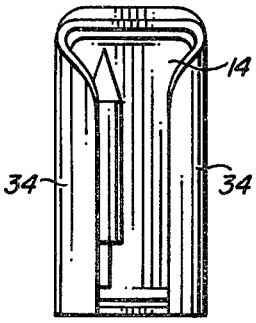

FIG. 4 is a top view of the ammunition clip. The side walls of the clip terminate in inwardly curved portions 34 for bullet retention against the force of pressure plate 14.

Figure 6:
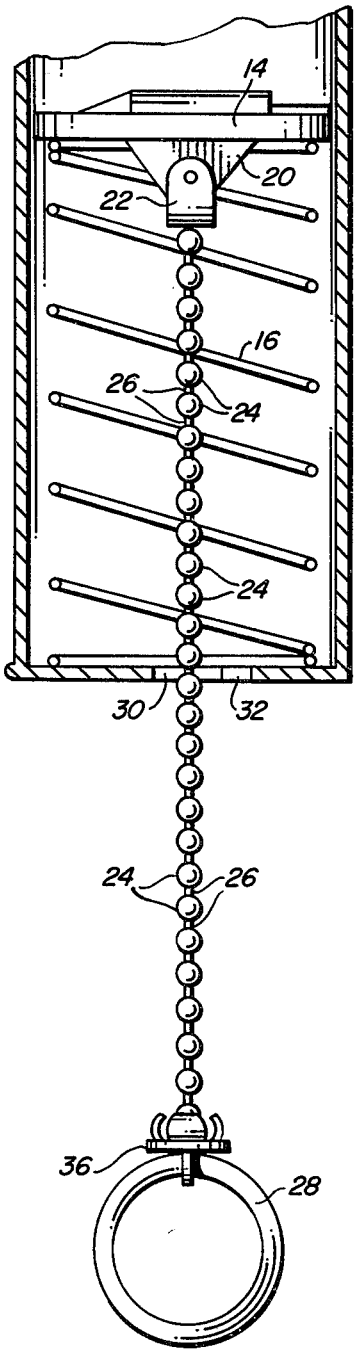
FIG. 6 illustrates the ammunition clip of FIG. 3 in a ready-to-load configuration.

The rapid load clip is operated as follows. Rather than having to load each cartridge against the force of the pressure plate as in the prior art, the pressure plate 14 is retracted by manually pulling ring 28. Once retracted, it is locked by placing one of the narrow connecting portions 26 in slot 32. With the pressure plate retracted and locked, the clip may be quickly loaded with cartridges through its upper open end. FIG. 6 illustrates the clip of FIG. 3 in a partially retracted position. FIG. 6 also illustrates an optional cap member 36 mounted on the exterior portion of the chain near the pull ring which fits into aperture 30 to prevent foreign matter from passing through the aperture into the clip housing.

Figure 1:
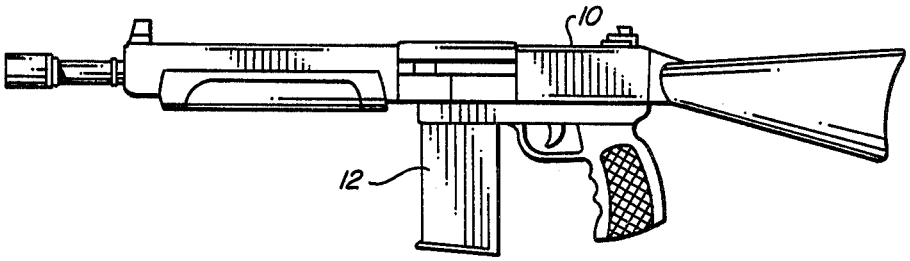
FIG. 1 illustrates an ammunition clip mounted in a weapon.
Figure 2:
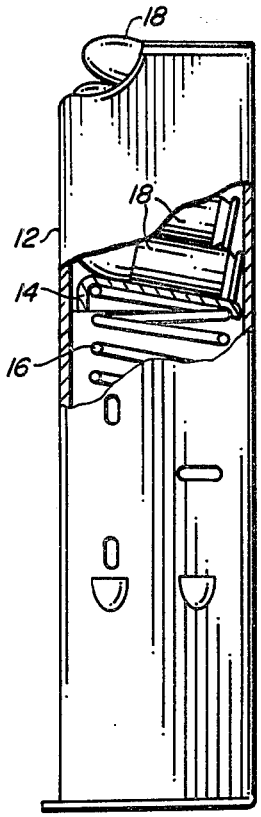
FIG. 2 is a cutaway view of an ammunition clip according to the prior art.
Figure 3:
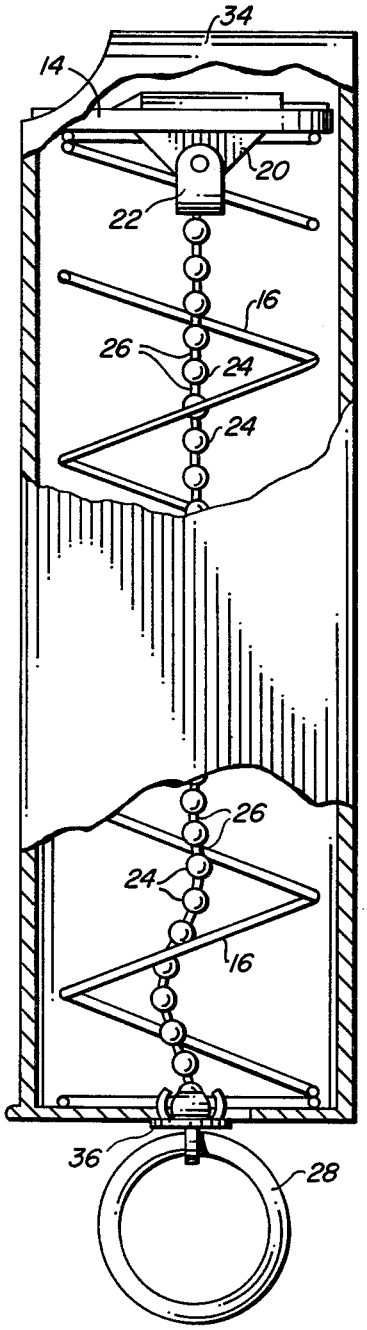
FIG. 3 is a cutaway view of a first embodiment of the inventive rapid load ammunitionn clip.
Figure 7:
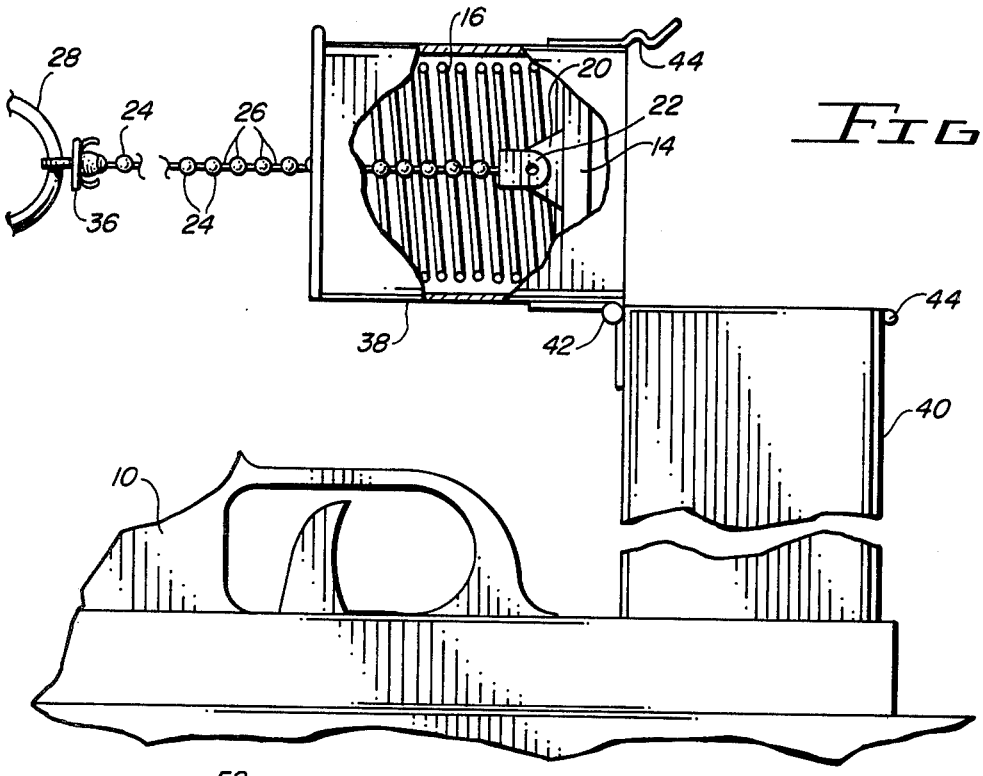
FIG. 7 illustrates a second embodiment of the inventive rapid load ammunition clip.

While the clip shown in FIG. 3 is a rapid load device, it must be removed from the weapon in which it is mounted before it can be reloaded. The clip of FIG. 3 may be modified to avoid this necessity as is shown in FIG. 7.

The clip is divided into first and second portions 38 and 40 coupled together at hinge 42. Latching means are provided at 44. Clip portion 40 is shown mounted in weapon 10. By retracting pressure plate 14 into portion 38, the clip may opened as is shown in FIG. 7. Cartridges may then be loaded into portion 40 without removing the clip from the weapon.

Figure 8:
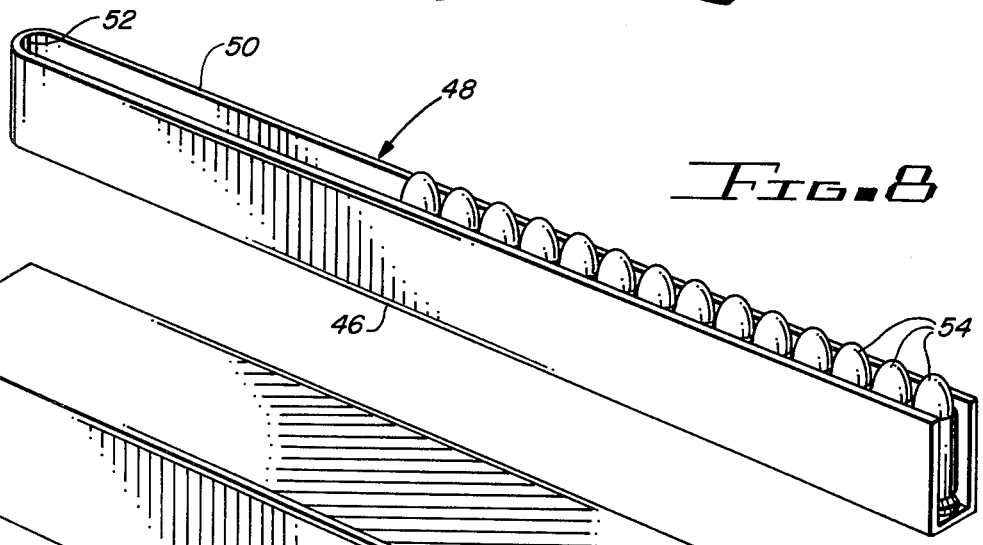
FIG. 8 illustrates a cartridge rack for use with the clip shown in FIg. 7.
Figure 9:
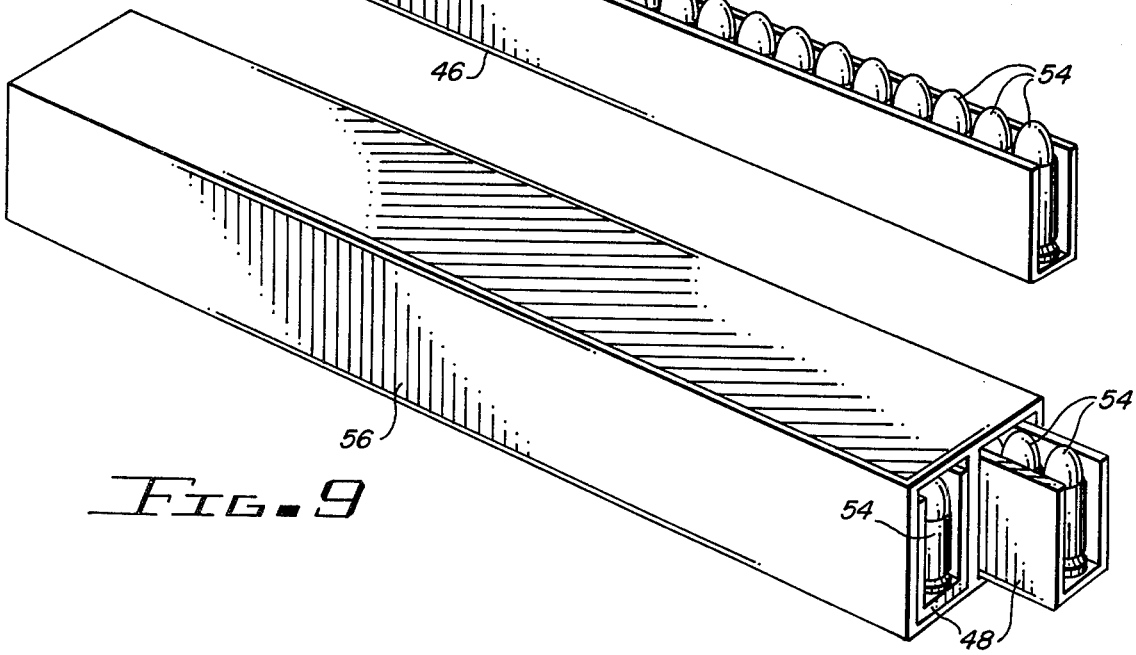
FIG. 9 illustrates a holder for cartridge racks of the type shown in FIG. 8.

The loading process may be speeded up by carrying cartridges 54 in a three-sided rack 48 having side walls 46 and 50 and a rear wall 52 as is shown in FIG. 8. The rack containing the proper number of cartridges may be inserted into clip portion 40 open end first. The cartridges 54 will fall into the clip as the rack is removed. FIG. 9 illustrates a dual channel holder 56 for housing first and second racks 48 each loaded with cartridges 54. Racks 48 and holder 56 may be made of any material which provides sufficient strength.

The above description is given by way of example only. Changes in form and details may be made by one skilled in the art without departing from the scope of the invention as defined by the appended claims. For example, the rack 48, which is preferably used for front loading a clip because the width of the rack 48 is narrow enough to fit into the smaller opening in the front of the clip can also be used to load the modified clip of FIG. 7. However, for this application, the rack 48 can be shortened and widened to permit a double row of cartridges to be inserted since the opening in the clip port 40, is substantially larger than the much smaller opening in the front part of the clip port 40, that is inserted into the weapon 10. Additionally, the cap member 36, serves the function of preventing the chain from being undesirably suspended from the clip portion 38 (see FIG. 7) during the firing of the weapon 10. Also, an indent in the form of a partially curved recess is preferably formed on the notch 32 to provide a seat for the sphere portions of the chain and thereby prevent inadvertent or accidental release of the chain out from the notch 32. Another advantage of the improved clip of this invention is in the case where rapid unloading of cartridges from the clip is desired which can easily be achieved when the spring 16 is compressed thereby permitting rapid unloading through the front or open portion of the clip.

I claim:

1. An improved ammunition clip of the type wherein an elongated chamber formed by side walls and an end wall houses a pressure plate which is forced by a spring against cartridges stacked within said chamber so as to move cartridges remaining in said clip toward a first end thereof opposite said end wall each time a cartridge is extracted from said first end, the improvement comprising:

first means coupled to said pressure plate and passing through said end wall for manually retracting said pressure plate against the force of said spring; and second means in said end wall for locking said first means and restraining said pressure plate in a retracted position to permit easy loading of cartridges into said clip through said first end;

said first means comprises:

a chain coupled to said pressure plate and consisting of alternating sections of larger and smaller dimensions; and a pull ring coupled to an end of said chain outside said chamber;

said second means comprises:

an aperture in said end wall of sufficient size to permit passage of the sections of said chain larger dimension; and a slot in said end wall and contiguous with said aperture, said slot having a width which is larger than said smaller dimension but narrower than said larger dimension, said pressure plate being restrained by placing one of said alternating sections of smaller dimension in said slot; and said chamber comprises first and second sections hingedly coupled together at a point intermediate said end wall and said first end such that said pressure plate may be retracted and restrained at a location between said end wall and the point where said first and second sections are coupled together to permit the loading of said clip while mounted in a weapon.

2. A rapid load ammunition clip, comprising:

an elongated housing formed by side walls and an end wall;

a pressure plate within said housing;

a spring coupled between said end wall and pressure pressure plate for biasing said pressure plate toward an open end of said housing thereby moving ammunition remaining in said housing toward said open end;

first means coupled to said pessure plate and passing thrugh said end wall for manually retracting said pressure plate against the force of said spring; and second means within said end wall for locking said first means and restraining said pressure plate in a retracted position to permit easy loading of ammunition into said clip through said open end;

said first means comprises:

a chain coupled to said pressure plate and consisting of alternating sections of larger and smaller dimensions; and a pull ring coupled to an end of said chain outside said housing;

said second means comprises:

an aperture in said end wall of sufficient size to permit passage of the sections of said chain of larger dimension; and a slot in said end wall and contiguous with said aperture, said slot having a width which is larger than said smaller dimension but narrower than said larger dimension, said pressure plate being restrained by placing one of said alternating sections of smaller dimension in said slot; and said housing comprises:

first and second sections hingedly coupled together at a point intermediate said end wall and said open end such that said pressure plate may be retracted and restrained at a locaton between said end wall and the point where said first and second sections are coupled together to permit said clip to be loaded when mounted in a weapon without removal.

* * * * *